US006421842B1

(12) United States Patent
Fujita

(10) Patent No.: US 6,421,842 B1
(45) Date of Patent: Jul. 23, 2002

(54) HOLDER FOR TOILET-BOWL SEAT AND SEAT LID OPERATING HINGES

(75) Inventor: Oriya Fujita, Kanagawa (JP)

(73) Assignee: Katoh Electrical Machinery Co., Ltd., Kanagawa (JP)

( * ) Notice: Subject to any disclaimer, the term of this patent is extended or adjusted under 35 U.S.C. 154(b) by 0 days.

(21) Appl. No.: 09/332,728

(22) Filed: Jun. 14, 1999

(30) Foreign Application Priority Data

Jun. 16, 1998 (JP) ..... 10-169043

(51) Int. Cl.[7] ..... A47K 13/12
(52) U.S. Cl. ..... 4/236; 4/234
(58) Field of Search ..... 4/236, 234, 240, 4/237, 242.1

(56) References Cited

U.S. PATENT DOCUMENTS 4,438,535 A * 3/1984 Paredes ..... 4/236
5,906,010 A * 5/1999 Suzuki ..... 4/236
5,946,740 A * 9/1999 Sorimachi ..... 4/236
6,009,568 A * 1/2000 Miyazaki ..... 4/236

* cited by examiner

*Primary Examiner*—David J. Walczak
(74) *Attorney, Agent, or Firm*—Notaro & Michalos P.C.

(57) ABSTRACT

A holder arrangement for a toilet-bowl having a body, a seat and a lid includes a holder with a case and a bottom opening for inserting a pair of operating hinges and a pair of opposite, coaxial, side openings at opposite ends of the holder case. A pair of fixtures project horizontally from the holder case for fixed the arrangement to the body of the toilet bowl. The pair of operating hinges each have a hinge case with a pair of legs and a rotating shaft projecting from the hinge case. The hinge cases and rotating shafts are coaxial to each other in the holder case, the operating hinges being inserting into the holder case through the bottom opening of the holder case and the rotating shafts extending out of the holder case through the side openings of the holder case. One rotating shaft is adapted for connection to the seat and the other is for connection to the lid. An engagement mechanism has of a pair of engagement pieces inside the holder case. Each engagement piece is for engaging one leg of each hinge case for fixing each hinge case in an axial position in the holder case.

1 Claim, 8 Drawing Sheets

HOLDER FOR TOILET-BOWL SEAT AND SEAT LID OPERATING HINGES

BACKGROUND OF THE INVENTION

1. Field of the Invention

The present invention relates to a bolder for removably holding hinges which support a seat and seat lid, respectively, of a toilet bowl.

2. Description of the Prior Art

One of the hinge holders of this type is known from the disclosure In the Japanese Patent Application No. 255855/94 (Japanese Provisional Publication No. 117148/96) of the Applicant of the present invention, Which proposed a hinge holder comprising a case provided with fixtures which are to be secured to the body of a toilet bowl and open at either axial end thereof. The case has an engagement means formed on the inner wall thereof in the proximity of each axial end thereof. A hinge case for each of toilet-bowl seat and seat lid operating hinges is inserted axially into the holder through a corresponding one of the end openings of the holder and engaged on a corresponding one of the engagement means. Each hinge comprises a rotating shaft having formed axially through it a non-circular hole into which there is engaged a non-circular fixing pin on which fixtures of the seat and seat lid are fitted. Thus the holder accommodates and holds therein the hinge came of the hinge.

The toilet-bowl seat and seat lid operating hinge have further been improved in that an adjusting screw is, penetrated axially through the rotating shaft; there are provided a stationary cam member in which the rotating shaft is inserted coaxially and which is not rotatable itself and a rotatable sliding cam member in which the rotating shaft is inserted coaxially and which is rotatable with the rotating shaft and slidable of the rotatable sliding cam member, the rotatable sliding cam member being located opposite to the stationary cam member, there is provided between the rotatable sliding cam member and a spring holder screwed to one end of the adjusting screw inside the hinge case a compression spring of which the effective length is to be adjusted by turning the adjusting screw to increase or decrease the elasticity of the compression spring in order to adjust the torque of the rotating shaft.

This operating hinge is disadvantageous in that if the fixture of the seat or seat lid is installed in the end opening of the holder formed axially of the rotating shaft with a fixing pin as in the conventional hinges of this type, when the hinge case has been engaged into the end opening of the holder, the fixing pin will interfere with manipulation of the rotating shaft so that the torque of the rotating shaft cannot freely be adjusted by means of the adjusting screw after the seat and seat lid are installed.

For the torque or the rotating shaft to be adjustable after the seat and seat lid are installed to the operating hinge and the rotating shaft to be removably installed in the holder, the rotating shaft of the operating hinge should be extended integrally by a fixing shaft portion on which the fixture of the seat or seat lid is to be secured and the head of the adjusting screw penetrated axially in the rotating shaft should be exposed at one end of the fixing shaft portion.

Thus in case the hinge case of the operating hinge is inserted into the case of the conventional holder through the opening formed at either end of the case. If the fixture of the seat or seat lid is independent of the seat or seat lid and removably fixable to the seat or seat lid, the fixture can be removed from the seat or seat lid and first inserted and fitted on the fixing shaft portion of the rotating shaft of the operating hinge of which the hinge case has been engaged in the case of the holder through the end opening, and then the end portion of the seat or seat lid can be installed on the fixture of the seat or seat lid. Therefore, the conventional holder is compatible with such a hinge so long as the fixtures of the seat and seat lid are removable. However, if the fixtures of the seat and seat lid are formed integrally with them, respectively, not to be removable, the fixtures of the seat and seat lid will interfere with installation of the operating hinges into the conventional holder, so that the hinges cannot be installed into the holder.

SUMMARY OF THE INVENTION

Accordingly, the present invention has an object to overcome the above-mentioned drawbacks of the prior art by providing a holder for operating hinges for a toilet-bowl seat and seat lid having fixtures integrally provided thereon, respectively, and which can be installed to the hinges, respectively, and also for operating hinges each having an operating shaft having a fixing shaft portion on which the fixtures of the seat and seat lid are to be fitted and which is to be projected out of a hinge case, in which operating hinges the torque of the operating shaft can freely be adjusted after the seat and seat lid are installed to the The above object can be attained by providing a holder in which a pair of operating hinges for a toilet-bowl seat and seat lid, respectively, is accommodated coaxially to be removable, comprising according to the present invention:

a case open at the bottom thereof and at either end thereof, engagement means provided inside the case and on which the operating hinges in pair are partially engaged respectively; and fixtures provided outside the case and by which the case is to be fixed to the body of the toilet bowl;

the pair of operating hinges being to be inserted into the case from the bottom opening of the case and engaged on the engagement means; and fixing shaft portions of rotating shafts of the hinges on which the fixtures of the seat and seat lid are coaxially fitted being to be projected out from the end openings of the case.

According to another aspect of the present invention, the engagement means may be engagement pieces provided inside the case and on which the operating hinges accommodated in the case are partially engaged.

According to a still another aspect of the present invention, the engagement means may be engagement projections provided inside the case and on which the ends of the pair of operating hinges accommodated in the case are engaged.

According to a yet another aspect of the present invention, the engagement means may be a fixing block inserted into the case from the bottom opening of the case and which abuts the ends of the pair of operating hinges accommodated in the case.

The above object can be attained also by providing a holder in which a pair of operating hinges for a toilet-bowl seat and seat lid, respectively, is accommodated coaxially to be removable, comprising according to the present invention:

a case open at the top whereof and at either end thereof;

fixtures provided outside the case and by which the case is to be fixed to the body of the toilet bowl;

a cover removably attached over the top opening of the case, and engagement pieces provided inside the cover to engage the ends of the operating hinges accommodated in the case;

the pair of operating hinges being to be inserted into the case from the top opening of the case;

fixing shaft portions of rotating shafts of the hinges on which the fixtures of the seat and seat lid tire coaxially fitted being to be projected out from the end openings of the case: and the engagement pieces provided on the cover resting on the ends of the operating hinges.

These objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
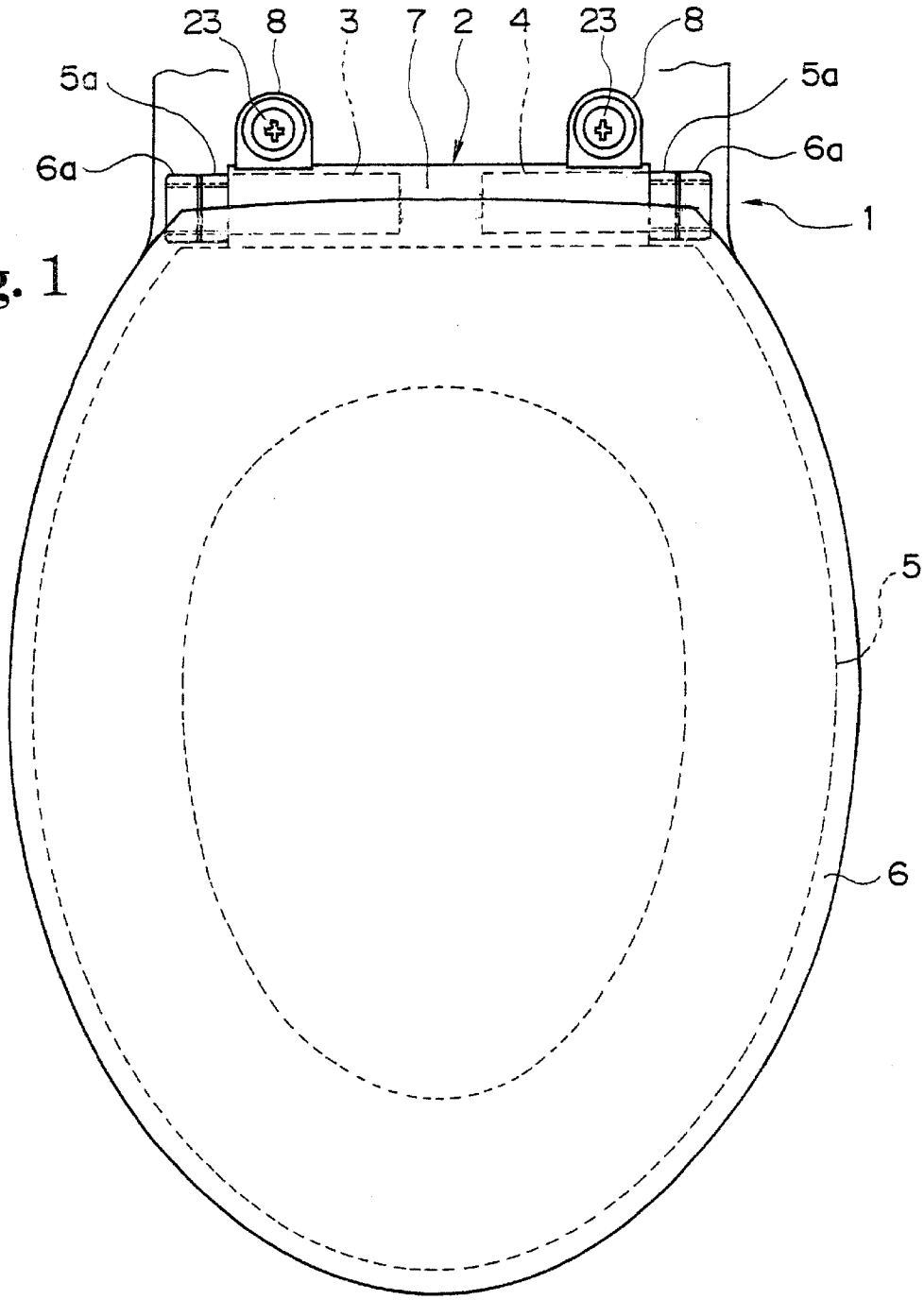
FIG. 1 is a plan view of a toilet bowl provided with a first embodiment of the holder according to the present invention and which holds a hinge which supports a seat and seat lid of the toilet bowl openably and closably.
Figure 2:
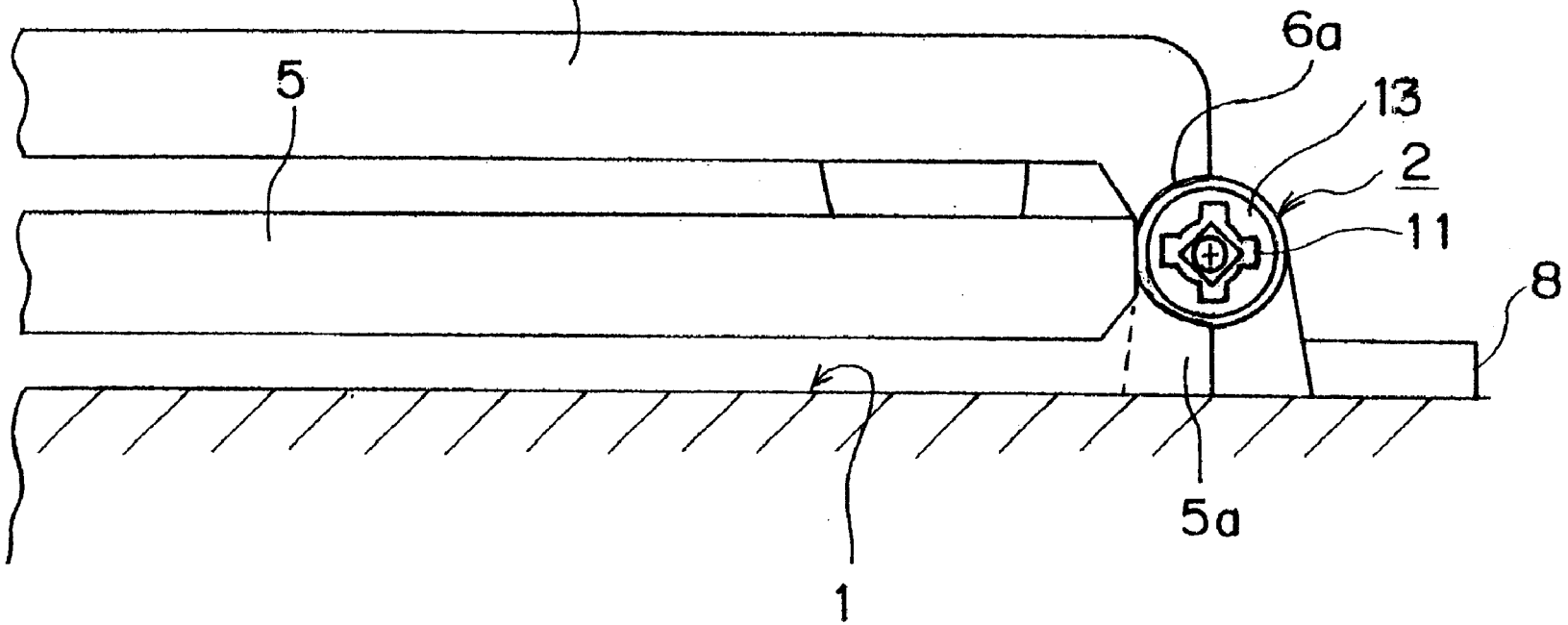
FIG. 2 is a fragmentary side elevation of the toilet bowl in FIG. 1.

Referring now to FIGS. 1 to 6, there is illustrated the first embodiment of the hinge holder according to the present invention. In Figures, the reference numeral 1 indicates the body of a toilet bowl, 2 indicates a hinge holder according to the present invention, 3 and 4 indicate a hinge for a seat 5 of the toilet bowl and a hinge for a seat lid 6 of the toilet bowl, respectively. The hinges 3 and 4 are removably installed inside the holder 2.

The holder 2 comprises a case 7 formed from a synthetic resin to have a semi-cylindrical shape open at the bottom thereof (as indicated with a reference numeral 7*b*) and at either end thereof (as indicated with reference numeral 7*c*), a pair of fixtures 8 projecting from the case 7, and a pair of engagement pieces 9 formed on the inner wall of the case 7 in the proximity of each end opening 7*c*.

The hinges 3 and 4 are inserted into the case 7 of the holder 2 form the bottom opening 7*b*, and rotating shafts 10 and 11 of the hinges 3 and 4, respectively, are projected out through the end openings 7*c* of the case 7. The hinges 3 and 4 have hinge cases 12 and 13, respectively, The hinge cases 12 and 13 are provided with FIGS. 12*a* and 12*b* and 13*a* and 13*b*, respectively, which extend downward, The logs 12*a* and 13*a* of the hinges 3 and 4, respectively, are fixed by engagement on the engagement pieces 9, respectively. The inside diameter of the end openings 7*c* is same as or smaller than the outside diameter of the, hinge cases 12 and 13 of the hinges 3 and 4 inserted in the case 7, and the case 7 has an end plate 7*d* at either end thereof (namely, the end opening 7*c* is formed in this end plate 7*d*). Therefore, the hinges 3 and 4 once inserted in the case 7 will not come out of the end openings 7*c* axially of the case 7.

Figure 3:
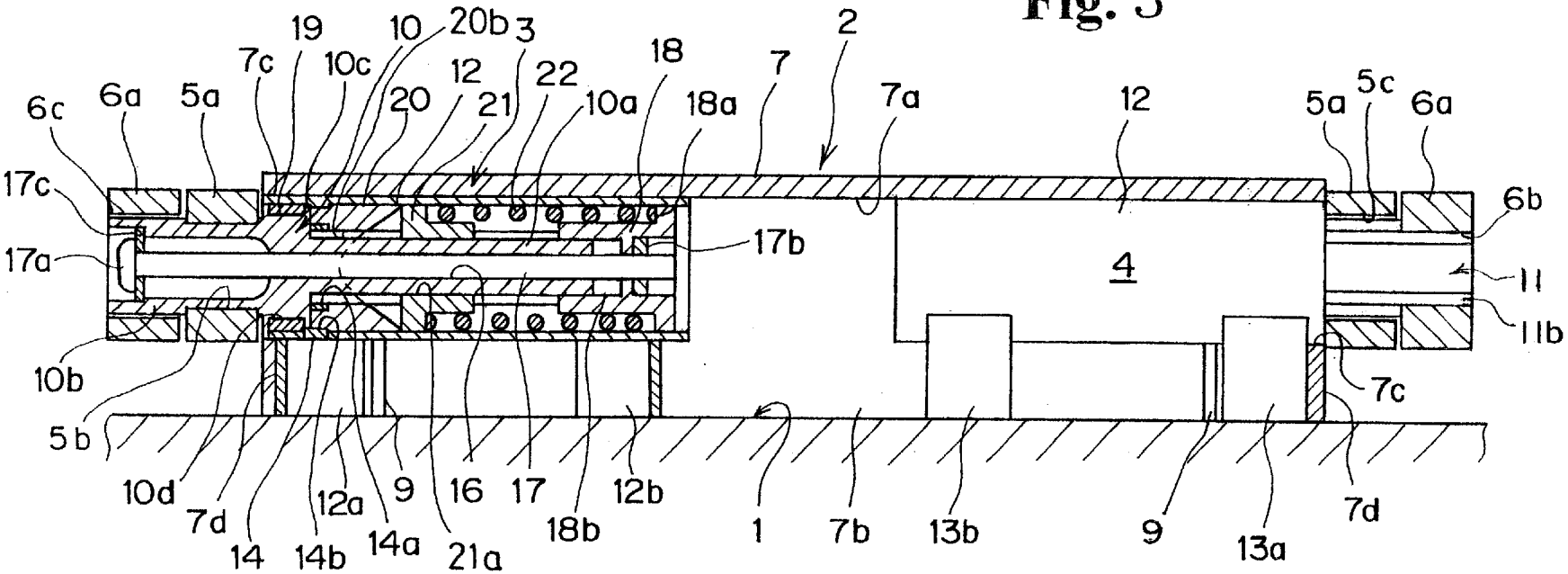
FIG. 3 is a partially sectional front view of the holder according to the present invention and in which the hinge for supporting the toilet-bowl seat and seat lid openably and closably is installed.

In FIG. 3, the left one (3) of the hinges 3 and 4 in pair accommodated in the case 7 of the holder 2 is for use with the seat 5 and the right one (4) is for use with the seat lid 6. It will be appreciated that the hinges 3 and 4 arm basically of a same internal structure provided that compression springs used in them, respectively, are different in elasticity from each other and also cam members are different in shape from each other mainly because the seat 5 and seat lid 6 are different in weight from each other.

Therefore, only the hinge 3 for the seat 5 will be described below concerning its structure.

The hinge case 12 of the hinge 3 is shaped cylindrical. The hinge case 12 has the above-mentioned pair of legs 12*a* and 12*b* spaced a predetermined distance from each other. When the hinge 3 is inserted into the case 7 of the holder 2, one of the pair of legs 12*a* and 12*b* at one end of the hinge case 12 is engaged on the engagement piece 9 inside the case 7 to block the hinge 3 from moving axially inside the case 7. Each of the legs 12*a* and 12*b* in pair has a bottom end formed to be flush with the bottom plane of the case 7 when the hinge 3 is set in the case 7.

Figure 4:
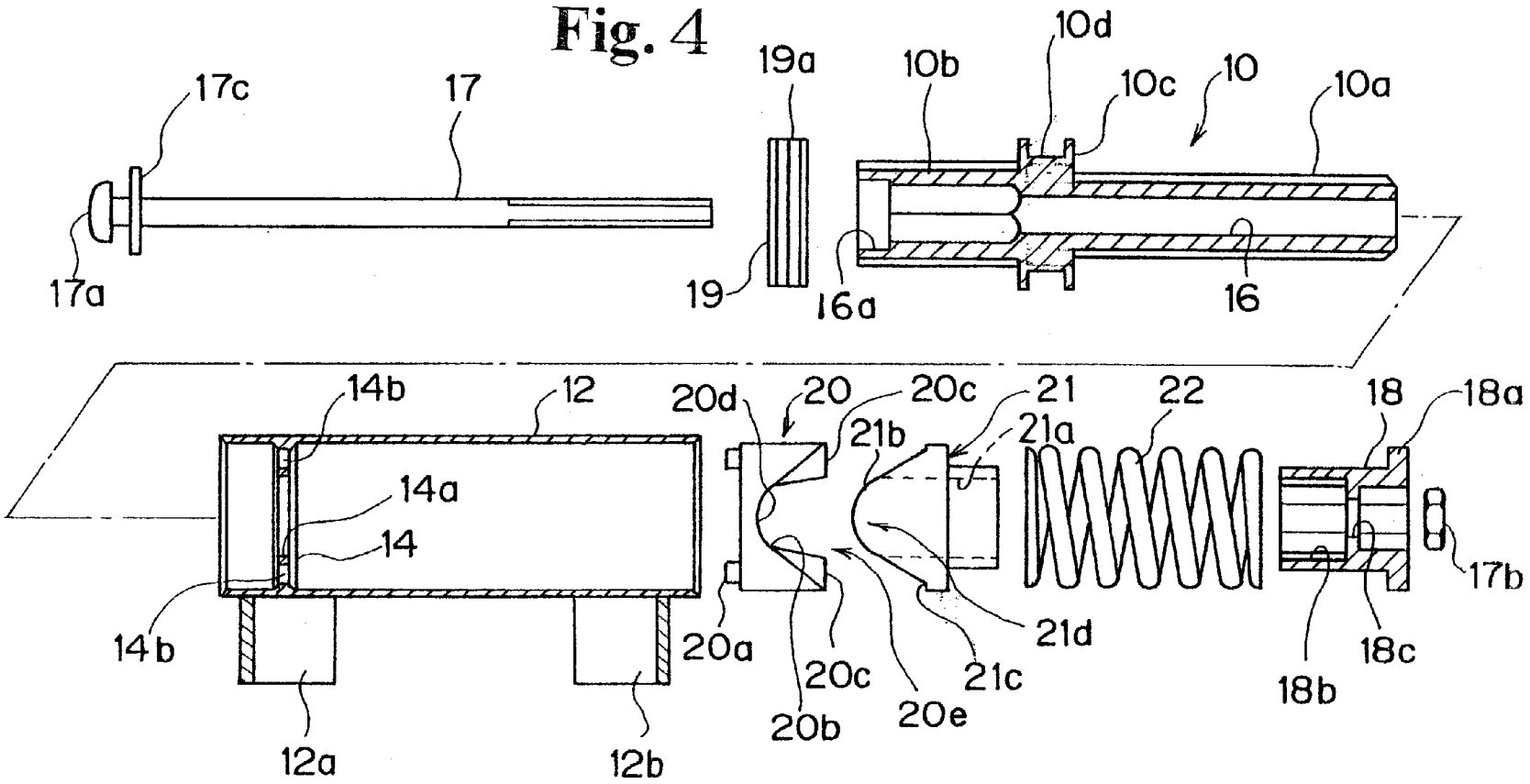
FIG. 4 is a partially sectional front view of a hinge for supporting the toilet seat and sent lid openably and closably and suitable for installation in the holder according to the present invention.
Figure 5:
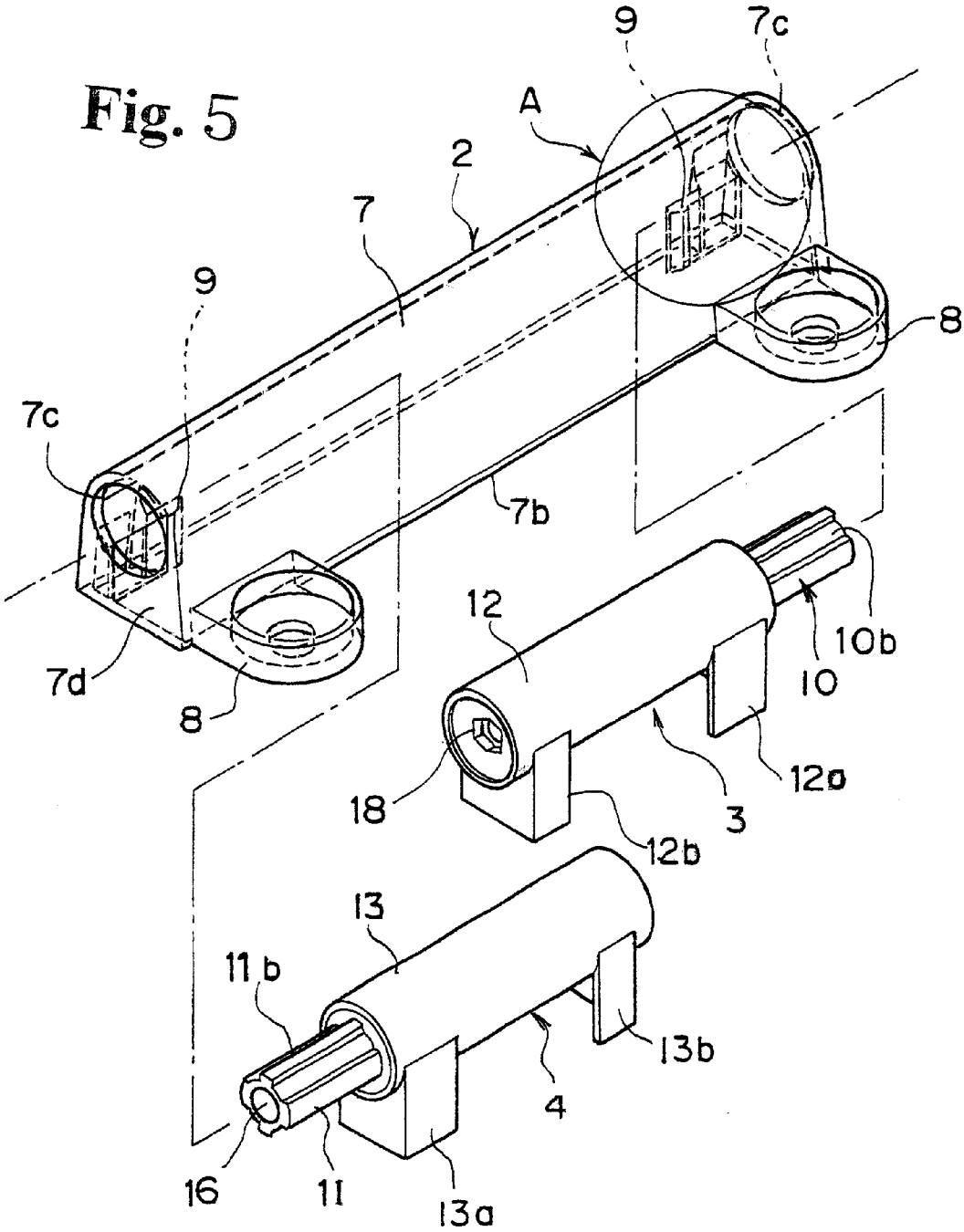
FIG. 5 is an exploded perspective view illustrating how to install the hinge for supporting the toilet seat and seat lid openably and closably in the holder according to the present invention.
Figure 6:
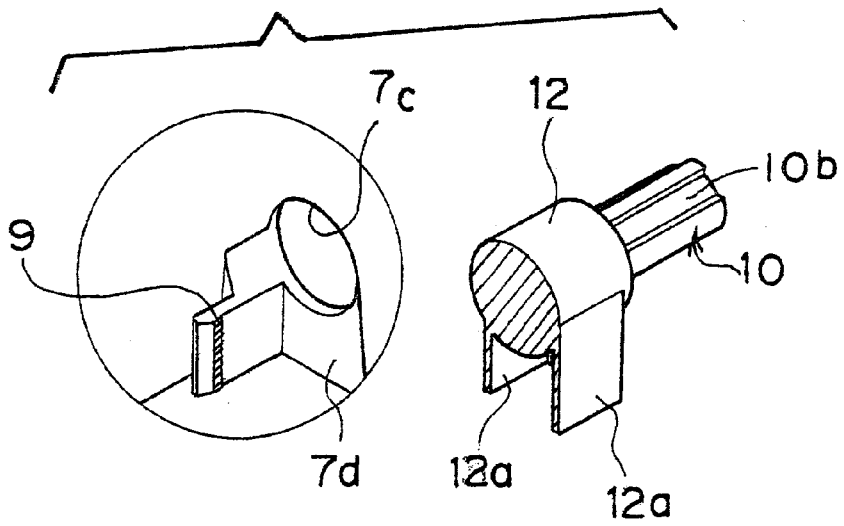
FIG. 6 shows a portion A in FIG. 5.

As best seen from FIG. 4, there is provided inside the hinge case 12 of the hinge 3 near the left end thereof a partition 14 having formed therein a bearing hole 14*a* through which the rotating shaft 10 extends axially inside the hinge case 12 and is rotatably installed therein. The rotating shaft 10 has a stepped central through-hole 16 formed therein and extending longitudinally thereof. An adjusting screw 17 is installed through the through-hole 16 and has a head 17*a* thereof engaged in a large-diameter portion 16*a* of the though-hole 16. The free-end portion of the adjusting screw 17 extending inside the case 7 is projected out of the end of the rotating shaft 10. A nut 17*b* screwed on the projecting portion of the adjusting screw 17 retains a spring holder 18. The reference numeral 17*c* indicates a washer. The spring holder 18 has formed at one end thereof a flange 18*a* which is in contact with the inner wall of the hinge case 12, and axially at the other end thereof a non-circular central engagement hole 18*b* which is engaged on a non-circular small-diameter portion 10*a* of the rotating shaft 10. The Spring holder 18 is thus rotatable with the rotating shaft 10 and axially slidable inside the hinge case 12. The reference numeral 18*c* indicates a small hole formed in the spring holder 18 and through which the adjusting screw 17 is penetrated. The rotating shaft 10 has a non-circular fixing portion 10*b* and a large-diameter portion 10*c* contiguous to the fixing portion 10*b*. The large diameter portion 10*c* has an outside diameter generally same as the inside diameter of the hinge case 12, and a circumferential groove 10*d* in which a rubber-made damper ring 19 is fitted. The damper ring 19 has a plurality of circumferential recesses 19*a* formed on the outer surface, and a viscous oil is filled between the outer surface of the damper ring 19 and inner wall of the hinge case 12.

As best seen from FIGS. 3 and 4, there is provided inside the hinge case 12 a stationary cam member 20 having provided at one end thereof a plurality of projections 20*a* engaged in a plurality of engagement holes 14*b* formed in the partition 14. The stationary cam member 20 has formed coaxially thereof a through-hole 20*b* having a circular section and through which the non-circular small-diameter portion load of the rotating shaft 10 is rotatably penetrated. The stationary cam member 20 has a cam portion 20*e* consisting of a crest 20*c* and trough 20*d*. Also a rotatable sliding cam member 21 is provided opposite to the cam portion 20*e* of the stationary cam member 20. It has formed coaxially thereof a non-circular through-hole 21*a* through which the non-circular small-diameter portion 10*a* of the rotating shaft 10 is penetrated. Thus the rotatable sliding cam member 21 rotates with the rotating shaft 10 and is also slidable axially of the rotating shaft 10. The rotatable sliding cam member 21 has a cam portion 21*d* consisting of a crest 21*b* and trough 21*c*. The cam portion 21*d* is opposite the cam portion 21*e* of the stationary cam member 20. There is provided between the rotatable sliding cam member 21 and the spring holder 18*a* compression spring 22 wound on the outer surface of the spring holder 18 and which forces the rotatable gliding cam member 21 towards the stationary cam member 20.

As shown in FIG. 3, the seat 5 has a fixture 5*a* in which a non-circular through-hole 5*b* is formed. With the non-circular fixing shaft portion 10*b* of the rotating shaft 10 penetrated through the through-hole 5*b*, the rotating shaft 10 is rotated with the seat 5 when the latter is operated (opened or closed). The seat lid 6 has a fixture 6*a* in which a circular through-hole 6*c* is formed. With the fixing shaft portion 10*b* of the rotating shaft 10 penetrated through the through-hole 6*c*, the seat lid 6 is pivoted about the rotating shaft 10 when it is opened or closed. Namely, the seat lid 6 will not rotate with the rotating shaft 10.

On the other hand, the rotating shaft 11 of the right-hand operating hinge 4 for the seat lid 6 bas a non-circular fixing portion 11*b* The fixing portion 11*b* is penetrated through a non-circular through-hole 6*b* in a fixture 6*a* of the seat lid 6, and the fixture 5*a* of the seat 5 has a circular through-hole 5*c* formed through it. Therefore, the rotating shaft 11 of the right-hand operating hinge 4 rotate with the seat lid 6 when the latter is operated, while it will not rotate when the seat 5 is operated.

In case the fixtures 5*a* and 6*a* are formed integrally with the seat 5 and seat lid 6, respectively, as in the present invention, the non-circular through-holes 5*b* and 6*b* and circular through-holes 5*c* and 6*c* in the fixtures 5*a* and, 6*a* are applied axially of the end openings 7*c* of the case 7 of the holder 2, and any one of the operating hinges 3 and 4 is first introduced into the case 7 from the bottom opening 7*b*. Then the next operating hinge is inserted into the case 7. More particularly, the operating hinge 2 is inserted from the bottom opening 7*b* into the case of the holder 2 and then displaced axially so that the rotating shaft 10 is projected out of the end opening 7*c* of the case 7, and the leg 12*a* is engaged on the engagement piece 9 while the rotating shaft 10 is introduced into the non-circular through-hole 5*b* and circular through-hole 6*c* in the fixtures, 5*a* and 6*a* respectively of the seat 5 and seat lid 6, respectively, Thereafter, the operating hinge 4 is inserted into the case 7 from the bottom opening 7*b* and displaced axially so that the rotating shaft 11 is projected out of the other end opening 7*c* of the case 7 of the holder 2, and the leg 13*a* is engaged on the engagement piece 9 while the rotating shaft 11 is introduced into the circular through-hole 5*c* and non-circular through-hole 6*b* in the other fixtures 5*a* and 6*a*, respectively, of the seat 5 and seat lid 6, respectively.

The holder 2 is positioned in place on the toilet-bowl body 1, and the fixtures 8 of the holder 2 are Secured to the toilet-bowl body 1 with fixing bolts 23.

After this installation, when the seat 5 is operated, the rotating shaft 10 is rotated correspondingly with the seat 5. With the seat 5 in closed position, the crest 20*c* of the cam portion 20*e* of the stationary cam member 20 is in contact with the crest 21*b* of the cam portion 21*d* of the rotatable sliding cam member 21 under the elasticity of the compression spring 22. When the seat 5 in opened position, the rotatable sliding cam member 21 rotates with the rotating shaft 10 so that the crest 21*b* of the rotatable sliding cam member 21 enters into the trough 26*d* of the stationary cam member 20. When the crest 21*b* has fully entered in the trough 20*d*, the seat 5 is fully opened (110°). When the Seat 5 is closed from the opened position, the crest 21*b* of the cam portion 21*d* will move from the trough 20*d* of the cam portion 20*e* towards the crest 20*c* against the elasticity of the compression spring 22. Thus, the sent 5 will be closed gently, not suddenly. Namely, the damper ring 19 will function to control the rotation of the rotating shaft 10.

The damper ring 19 should preferably have formed on the outer surface thereof a plurality of circumferential recesses 19*a* which will evenly spread an applied viscous over the outer surface of the damper ring 197 which will thus prevent any oil shortage.

To adjust the torque of the rotating shaft 10, a screwdriver is inserted from the end of the fixing shaft portion 10*b* of the rotating shaft 10 to turn the adjusting screw 17 clockwise or counterclockwise. It is not necessary to remove the operating hinge 3 from inside the holder 2. The spring holder 18 will move to the right or left so that the compression spring 22 will have the effective length thereof changed correspondingly. Thus the elasticity of the compression spring 22 can be adjusted whereby the torque of the rotating shaft 10 can freely be adjusted even after installing the operating hinge 3. This adjusting procedure is also true for the right-hand operating hinge 4.

Figure 7:
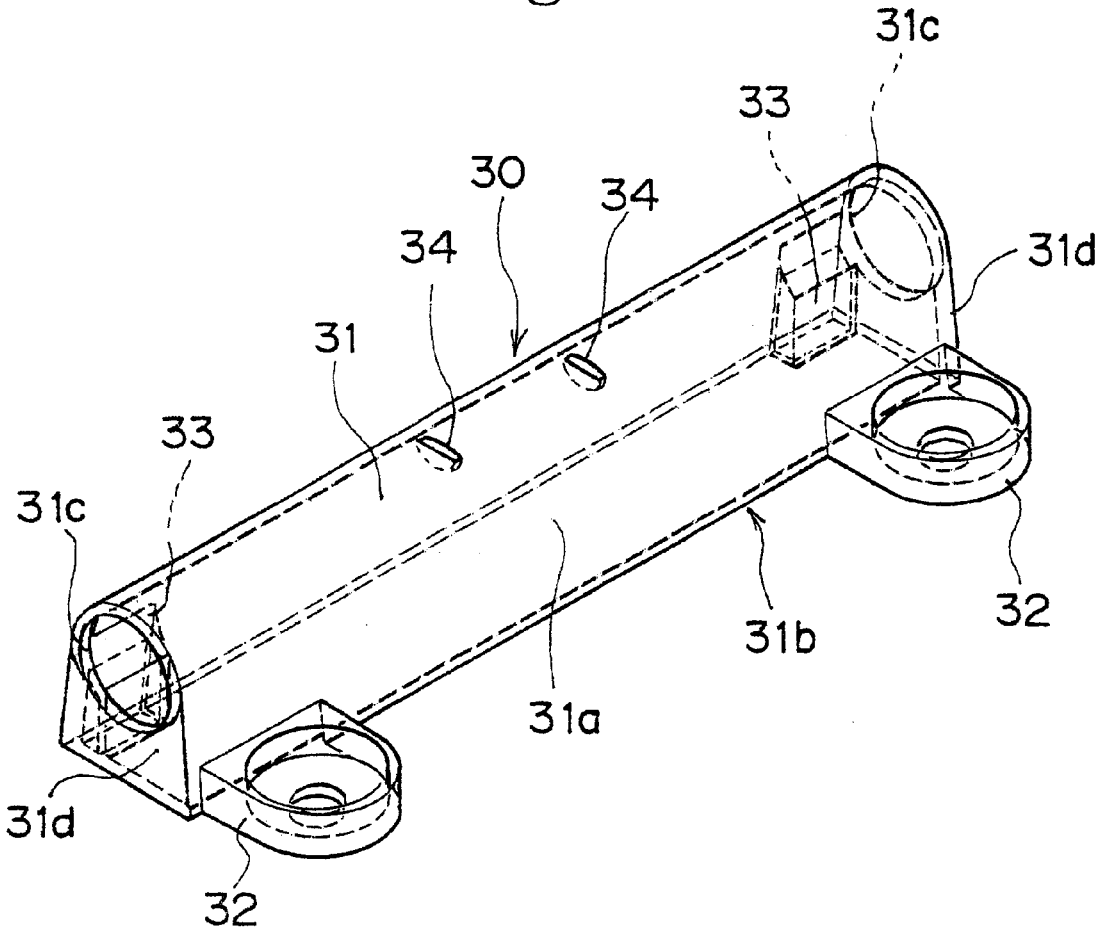
FIG. 7 is a perspective view of a second embodiment of the holder according to the present invention.
Figure 8:
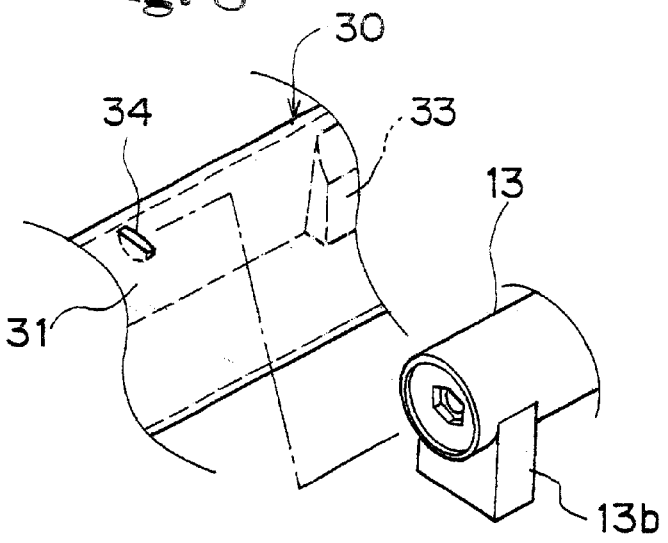
FIG. 8 shows how end of the hinge is engaged on an engagement projection provided on the inner wall of a hinge compartment of a case of the holder in FIG. 7.

FIGS. 7 and 8 show together another embodiment of the holder according to the present invention. The holder is generally indicated with a reference numeral 30. As shown, the holder 30 comprise a case 31, fixtures 32, bottom opening 31*b*, end openings 31*c*, and end plates 31*d*. Namely, the holder 30 is similar to the aforementioned embodiment except that the engagement pieces are not provided but only abutments 33 on which the legs of the operating hinges abut are provided inside the case 31 in the proximity of either end of the end openings 31*c* and pair of engagement projections 34 is provided on the upper inner wall of the case 31 with a predetermined distance between them.

According to this embodiment, the opening hinge accommodated into the case 31 from the bottom opening is blocked against axial movement by the engagement of the engagement projections 34 on one end of the hinge case 13 as will be best seen from FIG. 8.

Figure 9:
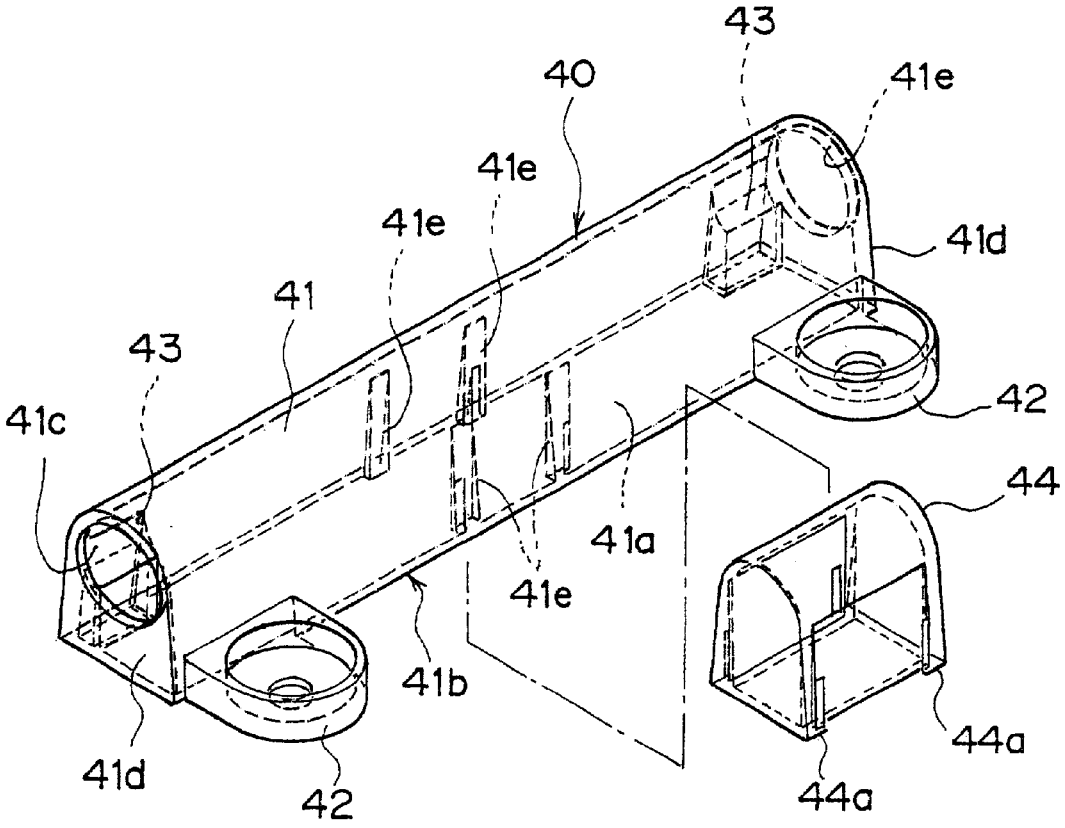
FIG. 9 is an exploded perspective view of a third embodiment of the holder according to the present invention.

FIG. 9 shows a still another embodiment of the holder according to the present invention. The holder is generally indicated with a reference numeral 40. The holder 40 comprises a case 41, fixtures 42, bottom openings 41*b* end openings 41*c*, end plates 41*d* and abutments 43. Namely, this embodiment is similar to the above-mentioned section embodiment of the holder according to the present invention provided that the engagement projections to engage the ends of the operating hinges are not provided and a fixing block 44 is installed removably inside the case 41. The fixing block 44 is to be inserted between opposite ends of the pair of operating hinges accommodated in the case 41. The fixing block 44 has formed at each corner thereof an engagement recess 44*a* in which each of engagement pieces 41*e* provided inside the case 41 is fitted. After the operating hinges are accommodated into the case, the fixing block 44 is introduced into the case to prevent the operating hinges from being moved axially.

According to this embodiment, the case 41 can be prevented from being expanded longitudinally and laterally. The operating hinges accommodated in the case 41 can be more securely fixed inside the case 41.

Figure 10:
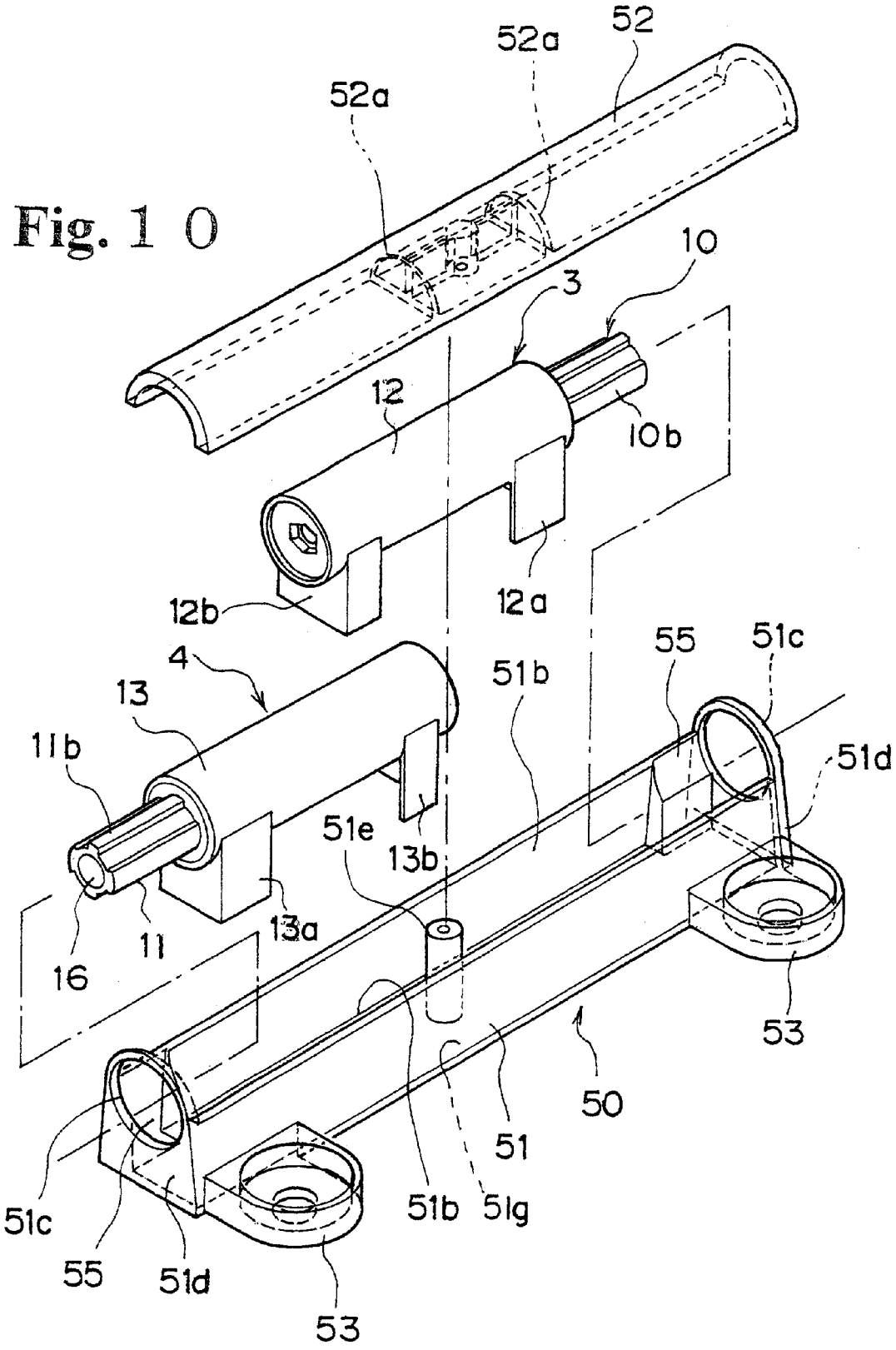
FIG. 10 is an exploded perspective view of a fourth embodiment of the holder according to the present invention.

FIG. 10 shows a further embodiment of the holder according to the present invention, The holder is generally indicated with a reference numeral 50. The holder 50 comprises a case 51, fixtures 53, end opening 51*c*, end plates 5*d* and abutments 55. Thus, this embodiment is similar to the aforementioned second and third embodiments except that the case 51 has formed at the top thereof an opening 51*b* through which the operating hinges 3 and 4 can be inserted into the case 50 front above and a cover 52 is provided to cover the top opening 51*b*. The case 51 is not open at the bottom thereof but it has a bottom plate 51*g*.

According to this embodiment, each of the operating hinges 3 and 4 can be inserted into the case 51 of the holder 50 from the top opening 51*b* and displaced axially. With legs 12*a* and 13*a* placed to abut the abutments 55, the rotating shaft 10 and 11 is projected out of the respective end openings 51*c*. Next, the cover 52 is attached on the top of the case 51. Using a screw (not shown), the cover 52 is fixed to a fixing boss 51*e* projected upright from the bottom plate 51*f* of the case 51. Engagement pieces 52*a* provided inside the cover 52 abut the ends of the operating hinges 3 and 4 to block the opening hinges 3 and 4 from being moved axially.

In the aforementioned embodiments of the holder according to the present invention, fixing concavities are provided in the fixtures by which the holder is secured to the body of a toilet bowl as will be seen from Figures and the concavities receive the beads of fixing bolts used to secure the holder to the toilet-bowl body. Covers are attached over the concavities as necessary.

What is claimed is:

1. A holder arrangement for a toilet-bowl having a body, a seat and a lid, the arrangement comprising;

a holder having a holder case with a bottom opening, the bottom opening being an aperture through a lower wall in the holder case sized to receive a pair of operating hinges therethrough, and a pair of opposite coaxial, side openings at opposite ends of the holder case;

a pair of fixtures projecting horizontally from the holder case for fixing the holder arrangement to the body of the toilet bowl;

a pair of operating hinges accommodated coaxially in the holder case, each operating hinge having a hinge case with a pair of legs and a rotating shaft projecting from the hinge case, the hinge cases and rotating shafts being coaxial with each other in the holder case, the operating hinges being inserting into the holder case through the bottom opening of the holder case and the rotating shafts extending out of the holder case through the side openings of the holder case, one rotating shaft being adapted for connection to the seat and the other rotating shaft being adapted for connection to the lid; and engagement means comprised of a pair of engagement pieces inside the holder case, each engagement piece being for engaging one leg of each hinge case for fixing each hinge case in an axial position in the holder case.

* * * * *